United States Patent [19]

Naka

[11] 4,443,973

[45] Apr. 24, 1984

[54] ACCESS DOOR AND FRAMING APPARATUS FOR THE ACCESS DOOR'S FRAMEWORK

[75] Inventor: Hiromitsu Naka, Saitama, Japan

[73] Assignee: Kabushiki Kaishi Naka Gijutsu Kenkyusho, Sapporo, Japan

[21] Appl. No.: 283,541

[22] Filed: Jul. 14, 1981

[30] Foreign Application Priority Data

Aug. 27, 1980 [JP] Japan ..... 55-118132

[51] Int. Cl.[3] ..... E06B 3/34

[52] U.S. Cl. ..... 49/381; 49/388; 49/400; 49/395; 49/463; 52/20

[58] Field of Search ..... 49/381, 388, 389, 397, 49/400, 463, 395; 52/656

[56] References Cited

U.S. PATENT DOCUMENTS

| | | | |
|---|---|---|---|
| 1,925,635 | 9/1933 | Hartley | 49/400 |
| 3,342,514 | 9/1967 | Invanhoe et al. | 52/656 X |
| 3,975,870 | 8/1976 | Naka | 49/463 X |
| 4,175,357 | 11/1979 | Goldhaber | 49/397 X |
| 4,190,929 | 3/1980 | Palka | 49/388 X |

*Primary Examiner*—Kenneth Downey

*Attorney, Agent, or Firm*—Wenderoth, Lind & Ponack

[57] ABSTRACT

An access door is constituted by an outer framework adapted to be fitted in a rough opening formed in a building ceiling, wall, or the like, an inner framework set in an opening in the outer framework, a cover plate secured to the inner framework so as to close an opening in the inner framework, a pair of bearings and axis for pivotally connecting the inner framework to the outer framework, and a locking means for locking the inner framework to the outer framework when the inner framework closes the opening in the outer framework. The bearings are projected on one framework of the opposite inner surfaces of the outer framework and the opposite outer surfaces of the inner framework, and have U-shaped bearing surfaces. The axis are projected on another framework of the opposite inner surfaces of the outer surfaces of the inner framework, and pivotally supported to the bearings, respectively.

22 Claims, 50 Drawing Figures

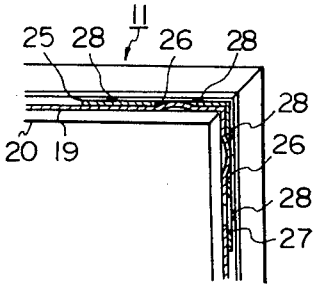
Fig. 26
Fig. 27
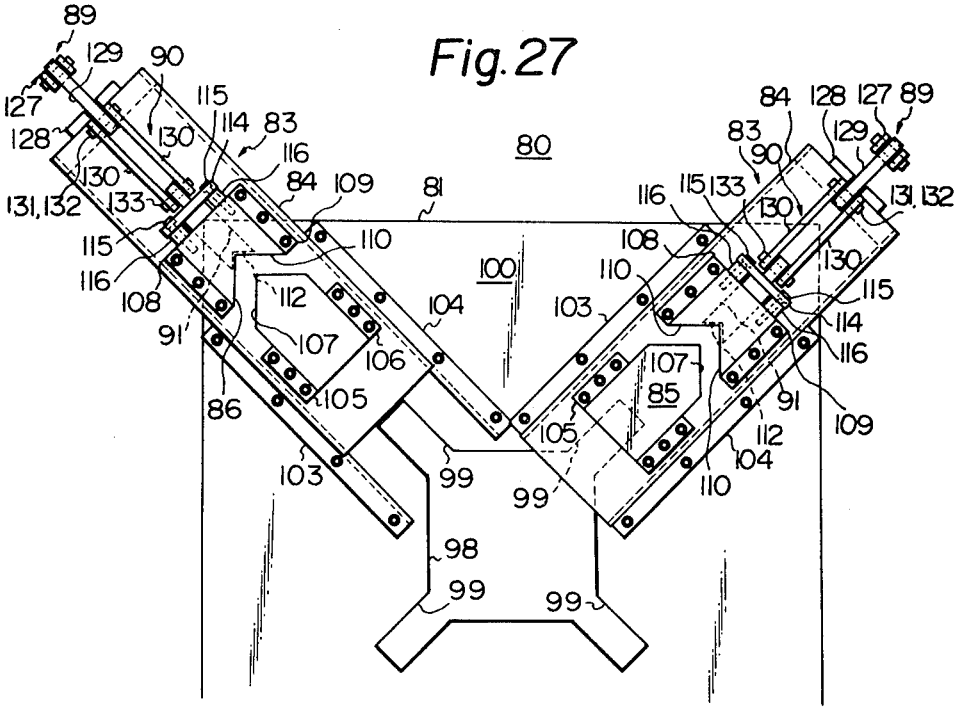

ACCESS DOOR AND FRAMING APPARATUS FOR THE ACCESS DOOR'S FRAMEWORK

BACKGROUND OF THE INVENTION

This invention relates to an access door adapted to be installed on a building ceiling or wall for facilitating inspection and/or repair of facilities such as wiring, piping and air ducts installed within the building ceiling or wall.

When the access door is designed to be installed in a building ceiling, for example, the access door includes an outer framework adapted to be fitted in a rough opening formed in the ceiling and secured to the ceiling by an anchoring device, an inner framework fitted in an opening of the outer framework and pivotally connected to the outer framework by pivot pins and pin-supports, and a cover plate fixed to the inner framework for closing the opening thereof. In this way a cover, that is to say, a door, of the access door is made up of the inner framework and the cover plate, and the cover is locked to the outer framework by a cremone locking means (casement window bolt type lock) when the cover closes the opening in the outer framework, and the cover is moved downwardly from the closed position to the open position on the pivot pins and the bearings when the cremone locking means is unlocked.

The outer and inner frameworks of the access door have been generally assembled by screwing four similar elongated aluminum or rolled steel outer and inner framework elements, which may be extruded, drawn or similarly processed elements, together with corner members interposed between the adjacent and opposed ends of the outer and inner framework elements, or the outer and inner frameworks of the access door have been assembled by putting four framework elements in square and hammering the corner members into each inserting groove, previously formed in the extruding or drawing process, of both edges of two framework elements abutted with each other.

In the access door having the above-described construction, without keeping it under lock and key, it is possible that the cremone locking means may be loosened and the cover may be opened by an earthquake, and that the cover may be opened without permission for facilitating inspection and/or repair of facilities.

And in the above-mentioned assembling method, the work efficiency is not good; moreover the framework elements are not closely and accurately abutted with each other at the corners of the frameworks, and therefore the manufactured access doors may not be uniform.

Furthermore, it is generally desired that the inner framework with the cover plate can be removed from the outer framework after the inner framework is opened, for the convenience of facilitating inspection and/or repair of facilities, but in the conventional access doors the outer framework thereof cannot be removed in the above-mentioned way, or even if the conventional access doors have a construction by which the inner framework can be removed after the cover is opened, in the closed condition, the cover is easily taken off the outer framework by an upward pressing force thereon, thereby resulting in a danger that the cover may fall unexpectedly. Such conventional access doors are therefore lacking in safety.

SUMMARY OF THE INVENTION

Therefore, one object of the present invention is to provide an access door which comprises an outer framework assembled in square by four outer framework elements and corner members, and an inner framework assembled in square by four inner framework elements and corner members, the outer and inner frameworks being easily assembled without screwing, whereby the access door can be assembled efficiently.

Another object of the present invention is to provide an access door as manufactured goods having uniformity, in which the outer and inner framework elements are closely and accurately abutted with each other at the corners of the outer and inner frameworks.

Another object of the present invention is to provide an access door in which after the inner framework is opened, the inner framework can be removed from the outer framework for facilitating inspection and/or repair of facilities, and in which when the inner framework is closed, the inner framework is not easily taken off the outer framework, thereby reducing the danger that the inner framework may fall unexpectedly and maintaining safety.

Another object of the present invention is to provide an access door in which the inner framework is positively kept in the closed condition such as in an earthquake, and the inner framework cannot be opened without permission for facilitating inspection and/or repair of facilities.

A further object of the present invention is to provide an access door in which a locking means for locking the inner framework to the outer framework is easily fixed to the inner framework without rattling, and after the locking means is fixed, the locking means is not loosened.

A still further object of the present invention is to provide a framing apparatus for the access door's framework which is assembled by putting four framework elements with an inserting groove in square and fitting corner members into the corresponding inserting groove, whereby framework elements are closely and accurately abutted with each other, the framework elements and the corner members are fixed in the close condition, and the manufactured frameworks are uniform.

BRIEF DESCRIPTION OF THE DRAWINGS

The above and other objects and advantages of the present invention will be more readily apparent from the following description when read in connection with the accompanying drawings.

FIG. 26 is a fragmentary cross-sectional view of the corner of the outer framework of the access door which is assembled by the framing apparatus as shown in FIG. 19;

FIG. 27 is a fragmentary plan view of the framing apparatus as shown in FIG. 19, showing the variable position of the table plate;

DETAILED DESCRIPTION OF THE INVENTION

Referring to FIGS. 1 through 38 of the accompanying drawings, one preferred embodiment 10 of an access door installed in a building ceiling, an assembling method for the access door 10, and framing apparatuses 80 and 150 for the access door 10 are shown.

Figure 1:
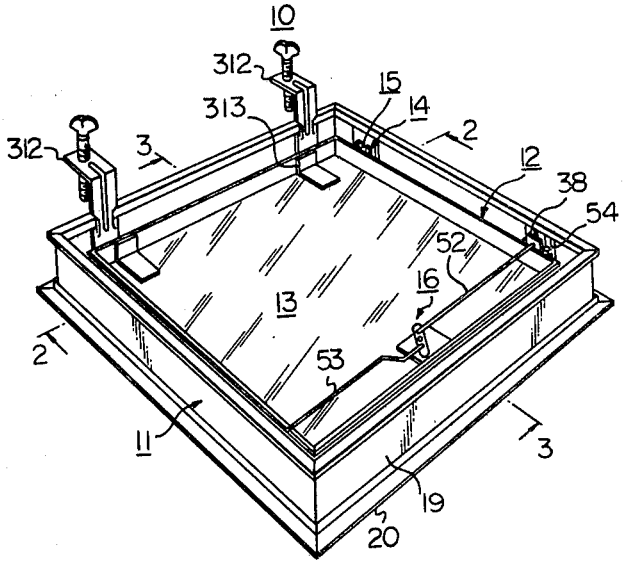
FIG. 1 is a perspective view of a preferred embodiment of an access door constructed in accordance with the present invention showing the same as being installed in a building ceiling.
Figure 2:
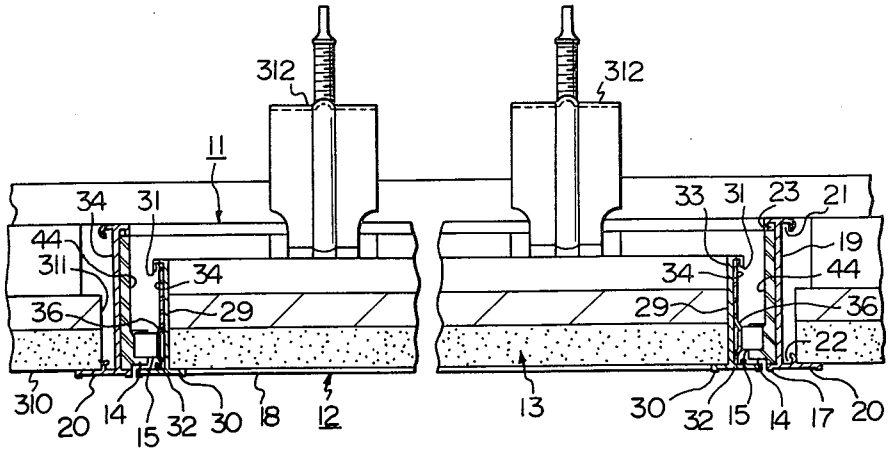
FIG. 2 is a cross-sectional view taken along substantially the line 2—2 of FIG. 1.
Figure 3:
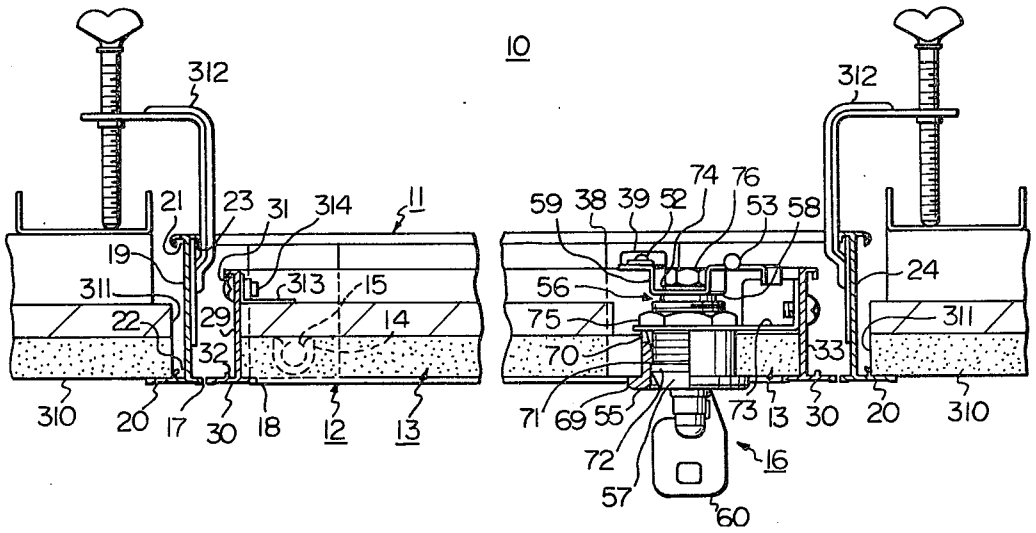
FIG. 3 is a cross-sectional view taken along substantially the line 3—3 of FIG. 1.

The access door 10 comprises a regular square outer framework 11 fitted in a correspondingly shaped rough opening 311 formed in a building ceiling 310 and secured to the building ceiling 310 by anchoring devices 312, a regular square inner framework 12 set in the opening 17 in the outer framework 11, a cover plate 13 secured to the inner framework 12 by means of fixtures 313 so as to close the opening 18 in the inner framework 12, a pair of bearings 14 horizontally projecting from both inside surfaces of the outer framework 11, a pair of pins 15 horizontally projecting from both outside surfaces of the inner framework 12 and pivotally supported in the bearings respectively, and a locking means 16, whereby the assembly of the inner framework 12 and the cover plate 13 is locked to the outer framework 11 by the locking means 16 when the cover is closed (as shown in FIGS. 1 through 3), and when the locking means 16 is unlocked, the cover is pivoted by the bearings 14 and the pins 15 and opened.

The outer framework 11 and the inner framework 12 have a regular square configuration, respectively, and are formed by assembling four similar elongated aluminum or rolled steel outer and inner framework elements, respectively, which may be extruded, drawn or similarly processed elements. Thus, the outer and inner framework elements are of extruded aluminum.

The outer framework 11 has framework webs 19, framework peripheral flanges 20 integrally formed at the lower ends of the framework webs 19 so as to engage the surface around the edges of the rough opening 311 and defines a framework opening 17, and inserting grooves 21, 22, 23. The outer framework 11 is formed by assembling four similar elongated outer framework elements provided with the inserting grooves, with four outer framework corner members 25, by the use of a framing apparatus 80 for the outer framework as described below.

Figure 4:
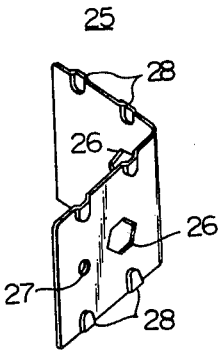
FIG. 4 is a perspective view of an outer frame corner member employed in an outer framework of the access door as shown in FIGS. 1 through 3.

FIG. 4 shows one outer framework corner member 25 employed to form the outer framework 11 by assembling four outer framework elements 24.

Each outer framework corner member 25 is formed as described below. At first, a steel plate is punched into a blank for the corner member by a mechanical press. The blank is provided with a pair of hexagonal locking holes 26 for locking the outer framework elements 24 in predetermined positions, a pair of receiving holes 27 for mounting a bearing bracket 44 in a predetermined position, and a plurality of projections 28 spaced from each other on the outside surface thereof, by another mechanical press. Thereupon the blank is bent to a right angle by another mechanical press.

For simplicity of manufacturing and assembling, it is desired that the outer framework corner members 25 be formed in symmetrical right and left members, so that the pair of hexagonal locking holes 26, the pair of receiving holes 27 and the plurality of projections 28 are formed in respective symmetrical positions.

The inner framework 12 has framework webs 29, framework peripheral flanges 30 integrally formed at the lower ends of the framework webs 29 so as to be located below the bearing 14 and defines a framework opening 18, and inserting grooves 31 and 32. The inner framework 12 is formed by assembling four similar elongated inner framework elements 33 provided with the inserting grooves, with two bearing side corner members 34 and two locking means side corner members 35, by the use of a framing apparatus 150 for the inner framework as described below.

The bearing side corner members 34 and the locking means side corner members 35 (FIG. 7) are formed from a steel plate by mechanical press the same way as the above-described outer framework corner members 25. However, in the bearing side corner members 34 and the locking means side corner members 35, the pair of receiving holes 27 of the outer framework corner member 25 are omitted.

Figure 5:
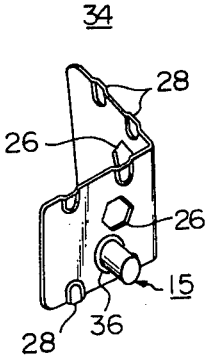
FIG. 5 is a perspective view of a bearing side corner member employed in an inner framework of the access door as shown in FIGS. 1 through 3.
Figure 6:
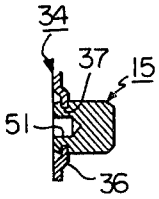
FIG. 6 is a fragmentary cross-sectional view of the bearing side corner member as shown in FIG. 5.

The bearing side corner member 34 as shown in FIGS. 5 and 6 is provided with a pair of hexagonal locking holes 26 and a plurality of projections 28 in symmetrical positions respectively, and furthermore in one side of the bearing side corner member 34 a pin fixing hole 37 is formed in a land 36 for the pin 15, by a mechanical press.

Figure 7:
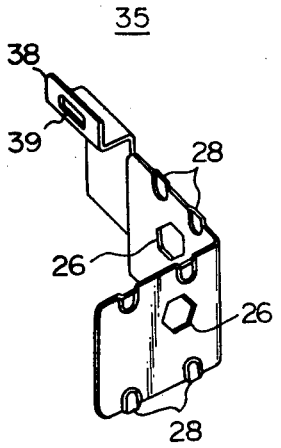
FIG. 7 is a perspective view of a locking means side corner member employed in the inner framework of the access door as shown in FIGS. 1 through 3.

The locking means side corner member 35 as shown in FIG. 7 is provided with a pair of hexagonal locking holes 26 and a plurality of projections 28 in respective symmetrical portions, and furthermore in one side of the locking means side corner member 35 a guide 38 for the locking bars 52 and 53 of the locking means 16 is integrally formed by a mechanical press. The guide 38 of the locking means side corner member 35 has a guide hole 39 for slidably supporting the locking bars 52 and 53 punched therein by a mechanical press.

The cover plate 13 shown in FIGS. 1 and 3 is set on the framework peripheral flanges 30 so as to close the opening 18 and is secured to the inner framework 12 by a plurality of fixtures 313 and screws 314. Ordinarily the same material as that of the ceiling finishing panels is employed in the cover plate 13.

Figure 8:
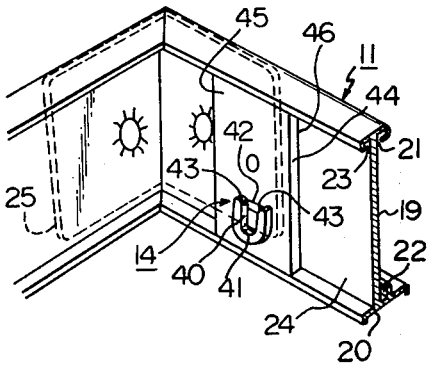
FIG. 8 is a fragmentary perspective view of the shaft side corner portion of the outer framework of the access door as shown in FIG. 1.
Figure 9:
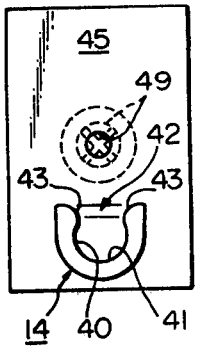
FIG. 9 is a front view of the bearing employed in the access door as shown in FIG. 1.
Figure 10:
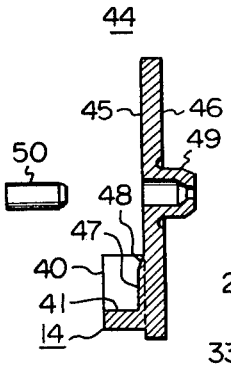
FIG. 10 is an exploded perpendicular cross-sectional view of the bearing shown in FIG. 9.
Figure 11:
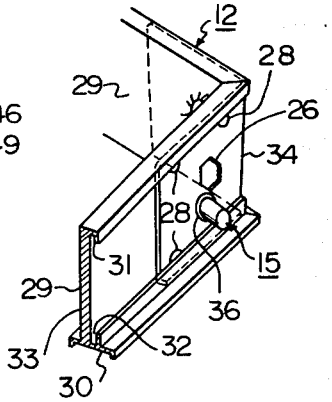
FIG. 11 is a fragmentary cross-sectional view of the shaft side corner portion of the inner framework of the access door as shown in FIG. 1.
Figure 12:
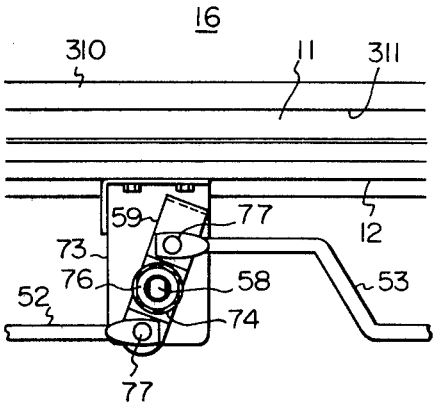
FIG. 12 is a fragmentary plan view of a locking means employed in the access door as shown in FIG. 1.
Figure 13:
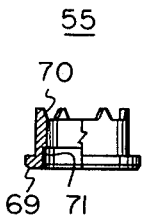
FIG. 13 is a front view of a tapping washer with sawteeth forming part of the locking means, and partially in cross-section.
Figure 14:
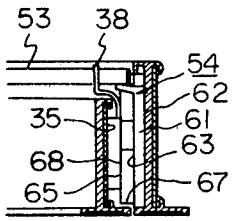
FIG. 14 is a fragmentary cross-sectional view of the access door, showing a forward end of a locking bar and a locking bar support of the locking means.
Figure 15:
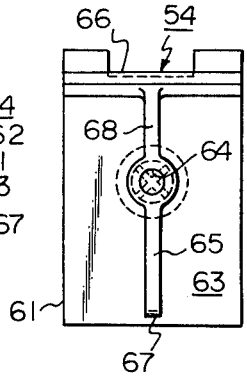
FIG. 15 is a front view of the locking bar support of the locking means.
Figure 16:
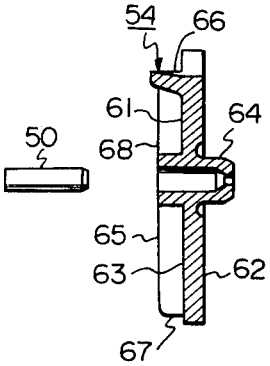
FIG. 16 is an exploded perpendicular cross-sectional view of the locking bar support as shown in FIG. 15.
Figure 17:
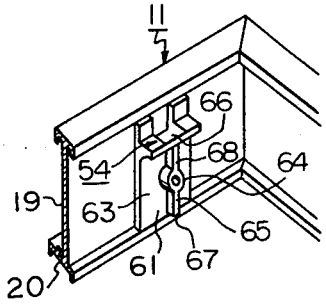
FIG. 17 is a fragmentary perspective view of the locking bar support side corner portion of the outer framework of the access door as shown in FIG. 1.
Figure 18:
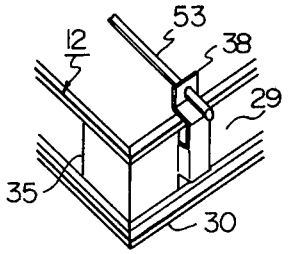
FIG. 18 is a fragmentary perspective view of the locking bar side corner portion of the inner framework of the access door as shown in FIG. 1.

In bearing 14 shown in FIGS. 8 through 10 a bearing surface 41 of a bearing groove 40 is formed in a U-shape, and in the upper portion of the opening 42 of the bearing groove 40 a pair of inwardly projecting portions 43 is integrally formed on the bearing surface 41.

Thus, each bearing 14 is provided with the portions 43 on the bearing surface 41, so that the upper portion of the opening 42 of the bearing groove 40 is substantially narrowed, whereby the pin 15 can be set in the bearing groove 40 with a snap fit and the pin can be pulled out of the bearing groove 40 with a snap.

The bearing 14 is integrally formed on a bracket 44 on one end thereof, whereby the bearing 14 can be easily secured to the outer framework 11. The other end of the bearing 14 will be adjacent to the framework web 29 of the inner framework 12, and the lower portion of the bearing 14 will be adjacent to the framework flange 30 of the inner framework 12 in order to act as a flange stop.

The bracket 44 is provided with a shaft end abutment surface 47 on the bracket inner surface 45 in the bearing groove 40 of the bearing 14, whereby the pin 15 can be easily set in and pulled out of the bearing groove 40 of the bearing 14, and the pin 15 is restricted in its movement in the longitudinal direction in the bearing groove 40 of the bearing 14.

In other words, the bracket 44 is provided with a shaft end abutment surface 47 on the bracket inner surface 45 in the bearing groove 40 of the bearing 14, whereby the inner framework 12 can be easily connected to and removed from the outer framework 11.

Furthermore, the shaft end abutment surface 47 is formed with an inclined surface 48 at the upper portion thereof, whereby the pin 15 can be smoothly moved into the bearing groove 40 of the bearing 14.

As clearly shown in FIG. 10, the bracket 44 is provided with a grooved sleeve 49 laterally projecting from the bracket outer surface 46. In order to fix the bracket 44 to the outer framework 11, at first the grooved sleeve 49 of the bracket 44 is put into a sleeve hole (not shown) formed in the framework web 19 of the outer framework 11, the bracket outer surface 46 of the bracket 44 is set against the inner surface of the framework web 19, and a knock pin 50 is forced into the grooved sleeve 49. When the knock pin 50 is forced into the grooved sleeve 49, the grooved sleeve 49 is expanded and the bracket 44 is fixed to the outer framework 11.

The bearing 14, the bracket 44 and the grooved sleeve 49 are integrally molded in one united body formed of polyamide resin, fluorocarbon resin or the like.

Each of pair of pins 15 is provided with a sleeve 51 having a smaller diameter than the pin 15 and integral with the inner end. As shown in FIGS. 2 and 6, the sleeve 51 is put into a pin mounting hole 37 in the bearing side corner member 34, and the head end of the sleeve 51 is fixed to a land 36 by calking.

The locking means 16 is a key-lock type, as shown in FIGS. 1 and 3, and 12 through 18. The locking means 16 comprises a pair of locking bars 52 and 53 on the inner framework 12 supported by guide members at the forward end, a pair of locking bar receivers 54 on the outer framework 11 positioned to receive the forward end of the corresponding locking bars 52 and 53, respectively, a tapping washer 55 with sawteeth extending through the cover plate 13, a cylinder lock 56 fitted into the tapping washer 55 and secured to the inner framework 12 by a bracket 73, a control plate 59 fixed to a plug 58 corresponding to the shaft passed through a plug box 57 of the cylinder lock 56 and connected to the base end of each of the locking bars 52, 53, respectively, and a key 60 for the cylinder lock 56.

The locking bars 52 and 53 correspond to the locking shafts of the cremone locking means. The locking bars 52 and 53 are fitted into the guide holes 39 formed in the guide members 38 of the respective locking means side corner members 35.

The locking bar receiver 54 is molded from polyamide resin, fluorocarbon resin so as to provide a bracket 61, a grooved sleeve 64 and a stop 65 in one united body, as shown in FIGS. 14 through 17. A receiving surface 66 of the locking bar receiver 54 is inclined, whereby the forward end of the locking bars 52 and 53 can be engaged with the receiving surface 66 in point contact.

In order to fix the bracket 61 of the locking bar receiver 54 to the outer framework 11, at first the grooved sleeve 64 is put into a sleeve hole (not shown) formed in the framework web 19 of the outer framework 11, the bracket outer surface 62 is placed against the inner surface of the framework web 19, and a knock pin 50 is forced into the grooved sleeve 64. When the knock pin 50 is struck the grooved sleeve 64, the grooved sleeve 64 is expanded and the bracket 61 is fixed to the outer framework 11.

The stop 65 on the bracket inner surface 63 has a stop surface 67 contacting the framework flange 30 of the inner framework 12 and a stop surface 68 contacting the guide member 38 of the locking means side corner member 35, whereby the rotation of the inner framework 12 is limited so it will not rotate upwardly from the closed position as shown in FIGS. 1, 2 and 3, and in the closed position, movement of the inner framework 12 in the axial direction of the pin 15 is prevented.

The tapping washer 55 is a sleeve having an outwardly extended flange 69 at the one end and sawteeth 70 at the other end and is made of metal, rigid synthetic resin or the like. In the inner surface of the flange 69 a recess portion 71 is formed, whereby an outwardly extended flange 72 on the plug box 57 can be inserted into the recess portion 71.

Since the tapping washer 55 is provided with the sawteeth 70, so the tapping washer 55 can be driven into the cover plate 13 until the outwardly extended flange 72 is in contact with the outer surface of the cover plate 13, making a hole in the cover plate 13.

The cylinder lock 56 is fixed to the inner framework 12, fitting in the tapping washer 55. The cylinder lock 56 is provided with plug box 57, plug 58 rotatably fitted in the plug box 57 so as to pass through the plug box 57, and pin tumblers (not shown) arranged in a row so as to be pushed by springs in the plug box 57.

The plug box 57 has an outwardly extended flange 72 at the lower end and the thread of a screw on the peripheral surface of the upper end.

In order to fix the plug box 57 to the inner framework 12, the plug box 57 is inserted into the tapping washer 55 until the outwardly extended flange 72 is contacted with the recess portion 71, and at this time the threaded upper end of the plug box 57 is fitted in a fixing hole (not shown) of the bracket 73, and the threaded upper end extending through the bracket 73 is held with a nut 75.

The plug 58 has a keyhole (not shown). The plug 58 passes through the plug box 57. The control plate 59 is mounted on the upper threaded portion of the plug 58 projecting from the plug box 57. Then a washer 74 is set on the upper threaded portion of the plug 58 and the upper threaded portion is held with a nut 76. Thus the control plate 59 is secured to the plug 58.

Therefore, when the plug 58 is operated by the key 60, the control plate 59 rotates with the plug 58. When the control plate 59 rotates like this, the pair of locking bars 52 and 53 are moved in and out the locking bar receivers 54, being slidably supported by the guide holes 39 of the guide members 38.

The locking means 16 constructed as above-described is secured to the cover plate 13 in the following way. At first the tapping washer 55 is driven into the cover plate 13, making a hole until the outwardly extended flange 69 is contacted with the outer surface of the cover plate 13. Thus the tapping washer 55 is secured to the cover plate 13 so that it will not rattle.

Then the cylinder lock 56 is fitted in the tapping washer 55 until the outwardly extending flange 72 is in the recess portion 71. The plug box 57 projecting from the tapping washer 55 is fitted in the fixing hole of the bracket 73. The threaded portion of the plug box 57 is held with the nut 75. The bracket 73 is secured to the plug box 57.

Then the bracket 73 is secured to the inner framework 12 by screws. Therefore, the plug box 57 which has the cylinder lock 56 within, is secured to the inner framework 12 while fitting in the tapping washer 55, and the tapping washer 55 is firmly secured to the cover plate 13 by the plug box 57.

The control plate 59 is mounted on the threaded portion of the plug 58, and the threaded portion is held with the washer 74 and the nut 76.

Further, the locking bars 52 and 53 are connected to the both ends of the control plate 59 by pins 77, respectively, and the forward end of each extends through the guide hole 39 of the corresponding guide member 38, or the locking bars 52 and 53 are previously connected to the ends of the control plate 59 by pins 77, then the forward end of each of the locking bars 52 and 53 is passed through the guide hole 39 of the corresponding guide member 38.

The locking bar receiver 54 is secured by the knock pin 50 as the same as described above.

Thus, the locking means 16 can be easily secured to the outer framework 11, the inner framework 12 and the cover plate 13 so that it will not rattle. After securing the locking means 16, the inner framework 12 having the cover plate 13 can be opened and closed by the key.

Figure 38:
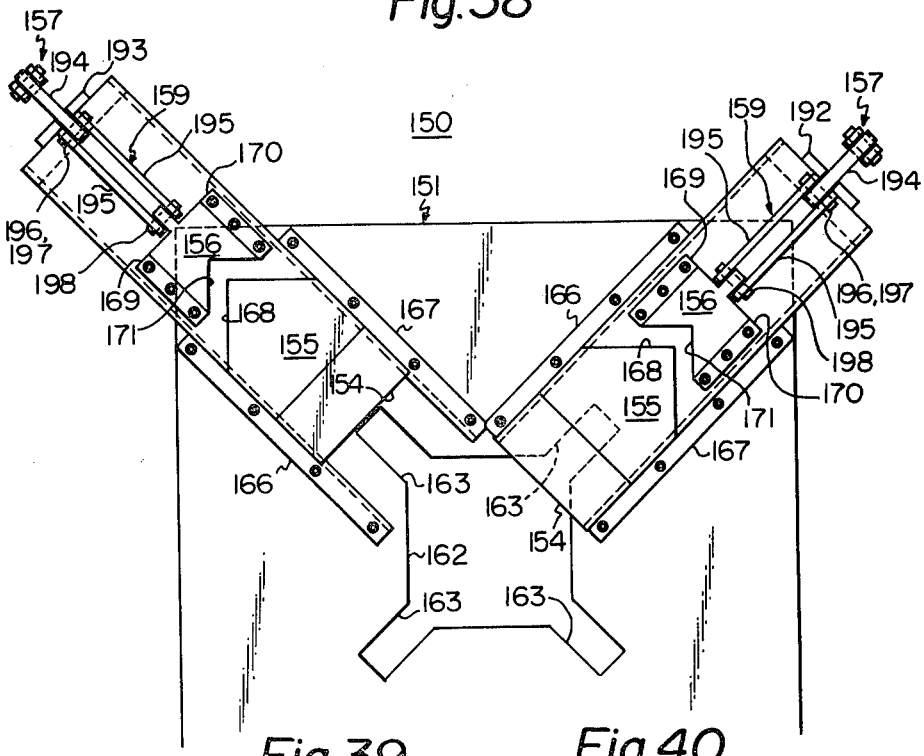
FIG. 38 is a fragmentary plan view of the framing apparatus as shown in FIG. 28, showing the variable position of the table plate.

The outer framework 11 and the inner framework 12 of the access door 10 having the above-described construction can be manufactured uniformly by the framing apparatuses 80 and 150, as shown in FIGS. 19 through 25, FIG. 27, and FIGS. 28 through 34 and, FIG. 38. In other words, the framing apparatuses 80 and 150 make possible uniform assembly of the outer framework 11 and the inner framework 12 by which the framework elements are accurately and closely put in square. In order to clarify the means by which the frameworks are assembled, the constructions of the framing apparatuses 80 and 150 are explained hereinafter and the framing assembly by the use of the framing apparatuses 80 and 150 is explained.

As shown in FIGS. 19 through 25 and FIG. 27, the framing apparatus 80 for the outer framework 11 comprises a square bed 81, a table 83 set on the square bed 81, four inside blocks 85 set on the inner side of the table 83, four outside blocks 86 set on the outer side of the table 83 so as to be opposite to the respective inside blocks 85 four hydraulic cylinders 87 for the inside blocks 85, a pneumatic hydraulic booster 88 for the hydraulic cylinders 87, four pneumatic cylinders 89 for the outside blocks 86, a four way type control valve 95 interposed in a pneumatic circuit 93 of the pneumatic hydraulic booster 88, a four way type control valve 96 interposed in a pneumatic circuit 94 of the pneumatic cylinders 89, four presses 91 set to the outside blocks 86 respective, and a linkage means 90 transmitting the power of the pneumatic cylinders 89 to the outside blocks 86.

The bed 81 is supported on four legs 82. As shown in FIG. 27, a square opening 98 is formed in the center of the bed 81. And the square opening 98 is provided with recess portions 99 extended in diagonal directions at the corners. The table 83 is set on the top face 100 of the bed 81. The pneumatic cylinders 89 are fixed to the respective legs 82 by brackets 101 so as to be set on the outside of the bed 81, and the pneumatic hydraulic booster 88 is fixed to the bed 81 by a bracket 102.

The table 83 consists of four table plates 84 set on the square bed 81 in diagonal directions. The table plates 84 are adjustably set on the bed 81 by guide members 103, 104 so as to go near and away each other in diagonal directions of the bed 81. Therefore, as the setting position of the table plate 84 can be adjusted as desired, the outer framework having the desired size can be provided by the table 83, as shown in FIG. 27.

Figure 23:
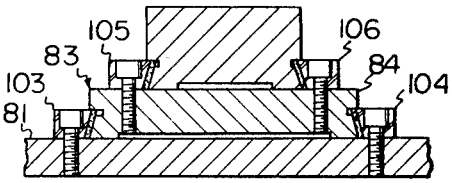
FIG. 23 is a cross-sectional view taken along substantially the line 23—23 of FIG. 21.

The inside blocks 85 are set on the respective table plates 84 of the table 83 so as to be near the square opening 98. As shown in FIG. 23, the inside blocks 85 are set on the table plates 84 by guide members 105 and 106 so as to slide in diagonal directions of the bed 81.

Each inside block 85 has a rectangular V-shaped receiving surface 107 at the front end. When the temporary outer framework 11 which is temporarily formed by putting four outer framework elements 24 with flanges in square by the use of the outer frame corner members 25, is set on the table 83, the inside blocks 85 can be brought into contact with the respective inner corners of the temporary outer framework 11.

Figure 20:
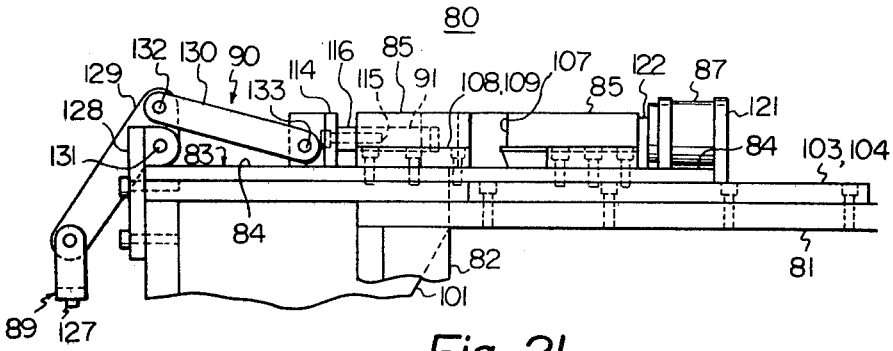
FIG. 20 is a fragmentary front view of the framing apparatus as shown in FIG. 19.
Figure 21:
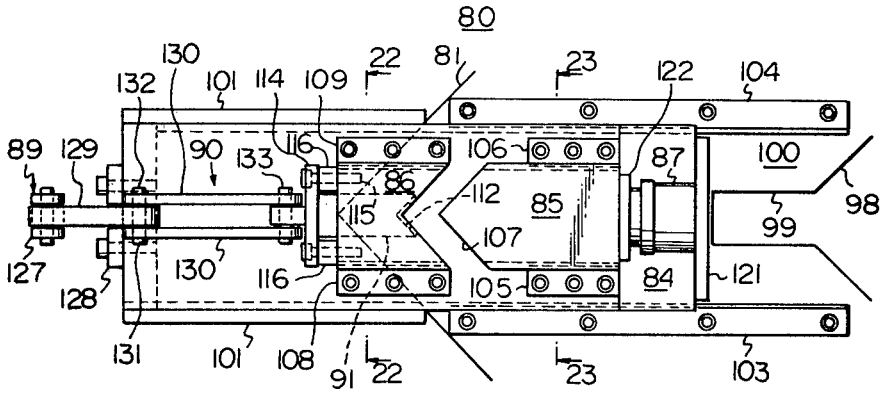
FIG. 21 is a fragmentary plan view of the framing apparatus as shown in FIG. 19.
Figure 22:
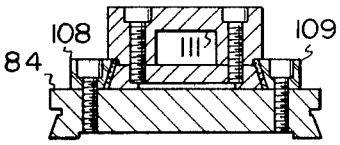
FIG. 22 is a cross-sectional view taken along substantially the line 22—22 of FIG. 21.

The outside blocks 86 are set on the table plates 84 of the table 83 respectively so as to be opposite to and apart at a proper distance from inside blocks 85. As shown in FIGS. 20 through 22, the outside blocks 86 are set on the table plates 84 by guide members 108 and 109 so as to slide in diagonal directions of the bed 81.

Each outside block 86 has a rectangular V-shaped pressing portion 110 at the front end thereof. When the temporary outer framework 11 is set on the table 83, the outside blocks 86 can be brought into contact with the respective outer corners of the temporary outer framework 11.

Each outside block 86 has a bore 111 passing therethrough in a diagonal direction of the bed 81 as shown in FIG. 22. The press 91 can be fitted in the bore 111 of the outside block 86.

Figure 24:
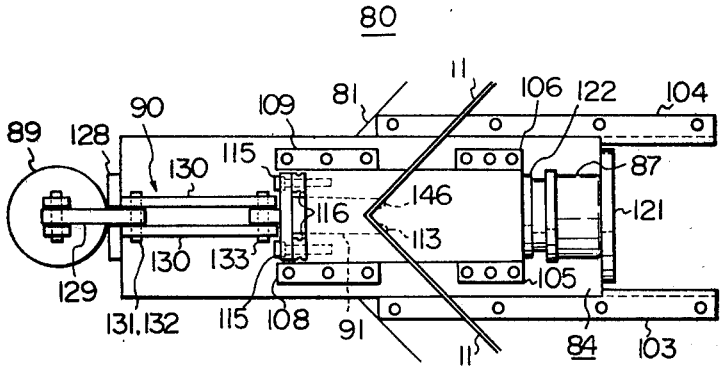
FIG. 24 is a fragmentary plan view of the framing apparatus in operating condition as shown in FIG. 21.

The press 91 has a rectangular V-shaped pressing surface 112 at the front end thereof, and the pressing surface 112 is provided with a pair of projections 113 as shown in FIG. 24. The press 91 has a flange 114 at the rear end thereof. The flange 114 is connected to the outside block 86 by a pair of guide bolts 115. Therefore, the sliding movement of the press 91 in a diagonal direction of the bed 81 against the outside block 86 can be limited by the guide bolts 115. A pressing pad 116 is arranged at the guide bolt 115 between the outside block 86 and the flange 114.

Figure 25:
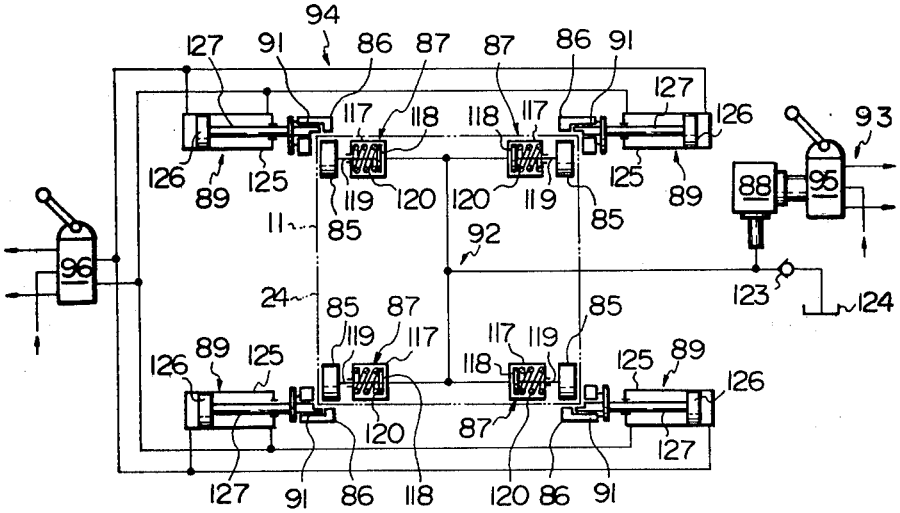
FIG. 25 is an air pressure-oil pressure circuit diagram of the framing apparatus as shown in FIG. 19.

Each hydraulic cylinder 87 is of the single action type as shown in FIG. 25. The hydraulic cylinder 87 comprises a cylinder 117, a piston 118 slidably fitted in the cylinder 117, a rod 119 and a return spring 120. The hydraulic cylinder 87 is set between a bracket 121 fixed to the rear end of the table plate 84 and a fixing plate 122 of the inside block 85 as shown in FIG. 24. Therefore, the inside block 85 can be slid in the diagonal direction of the bed 81, along the guide members 105 and 106 by the hydraulic cylinder 87.

The hydraulic cylinder 87 is operated by high pressure oil supplied from the pneumatic hydraulic booster 88 which is interposed in the hydraulic circuit 92. The hydraulic circuit 92 has a check valve 123 for the pneumatic hydraulic booster 88. The check valve 123 is connected with an oil tank 124.

As stated above, a four way type control valve 95 is interposed in the pneumatic circuit 93 of the pneumatic hydraulic booster 88. The four way type control valve 95 is connected with an air compressor (not shown) as a pneumatic source.

Each pneumatic cylinder 89 comprises a cylinder 125, a piston 126 slidably fitted in the cylinder 125 and a rod 127 whose base end is secured to the piston 126 and whose front end is extended outwardly from the cylinder 125. The pneumatic cylinder 89 is secured to the leg 82 of the bed 81 by the bracket 101. And the pneumatic cylinder 89 is connected with the corresponding outside block 86 by the corresponding linkage means 90. Therefore, when the four way type control valve 96 interposed in the pneumatic circuit 94 is operated, the outside block 86 can be slid on the table plate 84 in the diagonal direction of the bed 81 along the guide members 108, 109. The pneumatic circuit 94 for the pneumatic cylinder 89 is connected with an air compressor (not shown) as a pneumatic source.

The linkage means 90 comprises a bearing 128 fixed to the bracket 101 by screws, a lever 129 rotatably connected with the bearing 128 by a pin 131, and a pair of links 130 connected between the upper end of the lever 129 and the rear end of the press 91 by pins 132 and 133, as shown in FIGS. 20 and 21. The lower end of the lever 129 is connected with the rod 127 of the pneumatic cylinder 89 by a knuckle joint.

Hereinafter, the operation of the framing apparatus 80 having the above-mentioned construction for framing the outer framework 11 is described.

Figure 19:
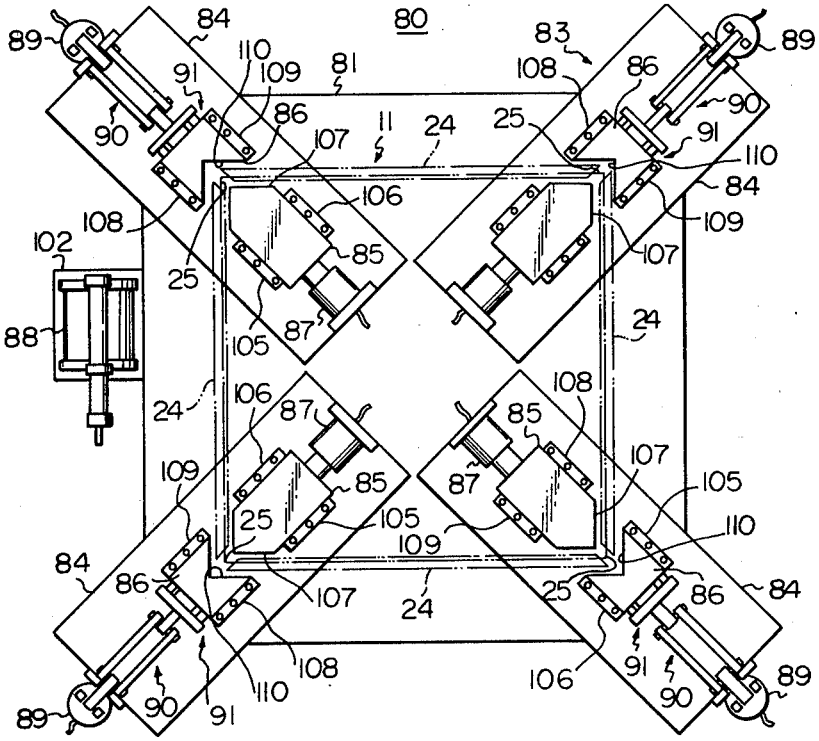
FIG. 19 is a plan view of a framing apparatus employed in assembly of the outer framework of the access door as shown in FIG. 1.

As shown in FIG. 26, four outer framework elements 24 with flanges, which have the inserting grooves 21 and 22 at the outside of their upper and lower ends, respectively, are put in square. The four corners, the outer frame corner members 25 are temporarily fitted into the inserting grooves 21 and 22 of the outer framework elements 24. Then, the thus temporarily assembled square outer framework 11 is set on the table 83 of the framing apparatus 80. More particularly since the framing apparatus 80 is in the condition as shown in FIG. 19, at first the temporary outer framework 11 is set on the table plates 84 between the inside blocks 85 and the outside blocks 86.

Secondly, the four way type control valve 95 is operated so that the pneumatic hydraulic booster 88 is brought into action so as to supply high pressure oil to each hydraulic cylinder 87.

Therefore, each hydraulic cylinder 97 is operated by the high pressure oil supplied from the pneumatic hydraulic booster 88, and each inside block 85 is shifted outward toward the corresponding outside block 86 along the guide members 105 and 106 on the corresponding table plate 84.

The four way type control valve 96 is then operated so that each pneumatic cylinder 89 is brought into action so that its rod 127 is upwardly pushed out of its cylinder 125, and each outside block 86 is shifted inward to a position opposite the corresponding inside block 85 by the corresponding linkage means 90.

Thus, when each outside block 86 is shifted in its position toward the opposite inside block 85 by the corresponding pneumatic cylinder 89, the corresponding corner of the temporary outer framework 11 is compressed between the rectangular V-shaped pressing portion 110 of the outside block 86 and the rectangular V-shaped receiving surface 107 of the opposite inside block 85.

When the temporary outer framework 11 is pressed by the outside blocks 86, the outer frame corner members 25 are fixed in the inserting grooves 21 and 22 of the outer framework elements 24 at the four corners.

After each corner of the temporary outer framework 11 is pressed by the outside block 86, the size of the temporary outer framework 11 is contracted, and the inner and outer surfaces of the temporary outer framework 11 are held under pressure between the rectangular V-shaped receiving surfaces 107 of the inside blocks 85 and the rectangular V-shaped pressing portions 110 of the outside blocks 86 as shown in FIG. 24, the presses 91 are pushed out by the pneumatic cylinder 89 and the linkage means 90. In other words, the presses 91 are shifted in position toward the inside blocks 85 so as to move relatively to the outside blocks 86, and the rectangular V-shaped pressing surfaces 112 of presses 91 are projected inwardly of the rectangular V-shaped pressing portions 110 of the outside blocks 86.

Attending this action of the press 91, the projections 113 of the rectangular V-shaped pressing surfaces 112 press against the corresponding portions of the framework web at the four corners, and the corresponding portions of the framework web are deformed. The thus deformed portion of the inner surface of the framework web are pressed into the locking holes 26 of the outer frame corner members 25 and the outer framework 11 is formed by connecting four outer framework elements 24 in square by the outer frame corner members 25, as shown at one corner in FIG. 24.

When the four way type control valve 96 is reversely operated, each pneumatic cylinder 89 reverses its action so that the rod 127 is downwardly pulled in the cylinder 125, and each outside block 86 is shifted away from the opposite inside block 85 by the linkage means 90 and is returned to the former position as shown in FIG. 21.

Then, when the four way type control valve 95 is reversely operated, the pneumatic hydraulic booster 88 acts in reverse so that the piston 118 of each hydraulic cylinder 87 is returned to its initial position by the return spring 120, as shown in FIG. 25.

Attending the reverse action of the piston 118, each inside block 85 is also shifted in its position along the guide members 105 and 106 on the corresponding table plate 84, so as to separate from the opposite outside block 86, and each inside block 85 is returned to the position shown in FIG. 19.

When the distance between each inside blocks 85 and the opposite outside block 86 is increased, as shown in FIGS. 19 through 21, the outer framework 11 can be taken out of the framing apparatus 80.

FIGS. 28 through 34, and FIG. 38 show the framing apparatus 150 for the inner framework 12. The framing apparatus 150 comprises a square bed 151, a table 153 set on the square bed 151, four inside blocks 155 set on the inner portion of the table 153, four outside blocks 156 set on the outer side of the table 152 so as to be opposite to respective ones of the inside blocks 155 four pneumatic cylinders 157 for the outside blocks 156, for presses 158 set to the respective inside blocks 155, and a linkage means 159 for transmitting the power of the pneumatic cylinders 157 to the outside blocks 156. The framing apparatus 150 is provided with a four way type control valve 161 interposed in a pneumatic circuit 160 of the pneumatic cylinders 157, hydraulic cylinders 176 for actuating a needle rod 174 of each press 158, a pneumatic hydraulic booster 178 interposed in a hydraulic circuit 177 of the hydraulic cylinder 176, and a four way type control valve 180 interposed in a pneumatic circuit 179 of the pneumatic hydraulic booster 178.

The bed 151 is supported vertically by four legs 152. As shown in FIG. 38, a square opening 162 is formed in the center of the bed 151. The square opening 162 is provided with recess portions 163 extended in diagonal directions at the corners. The table 153 is set on the top face 164 of the bed 151. And the pneumatic cylinders 157 are fixed to the legs 152 respectively by brackets 165 so as to be set on the outside of the bed 151, and the pneumatic hydraulic booster 178 is fixed to the bed 151 by a bracket 202.

The table 153 consists of four table plates 154 set on the square bed 151 in diagonal directions. The table plates 154 are adjustably set on the bed 151 by guide members 166 and 167 so as converge and diverge in diagonal directions of the bed 151. By adjusting the position of the table plates 154, an outer framework of any desired size can be constructed on the table 153, as shown in FIG. 38.

Figure 32:
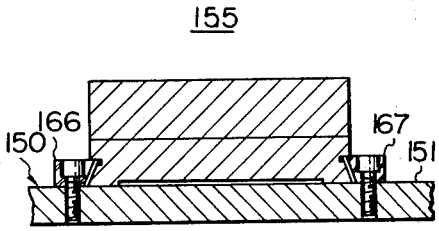
FIG. 32 is a cross-sectional view taken along substantially the line 32—32 of FIG. 30.
Figure 30:
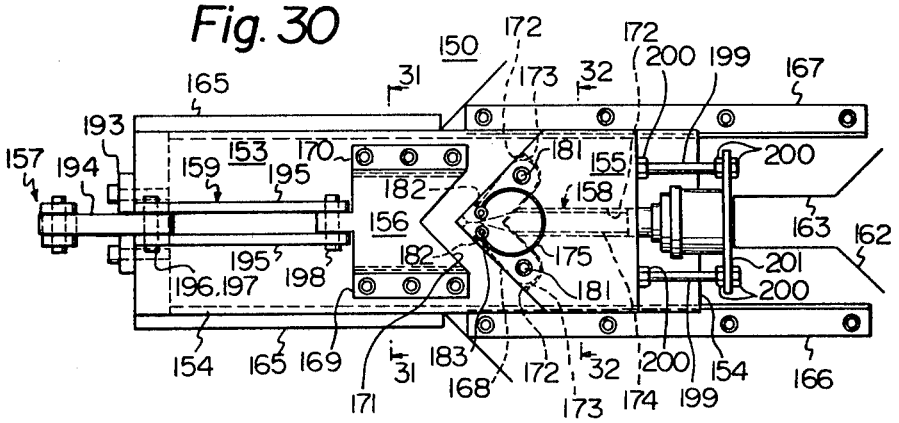
FIG. 30 is a fragmentary plan view of the framing apparatus as shown in FIG. 28.

The inside blocks 155 are secured to the upper surfaces of the respective table plates 154 of the table 153, in the predetermined positions near the square opening 162, as shown in FIGS. 30 and 32.

Each inside block 155 has a rectangular V-shaped receiving surface 168 at its front end. When the temporary inner framework 12, which is temporarily formed by putting four inner framework elements 33 with flanges in square by the use of the axis support side corner members 34 and the locking means side corner members 35, is set on the table 153, the inside blocks 155 can be brought into contacted with the inner corners of the temporary inner framework 12, respectively.

Figure 31:
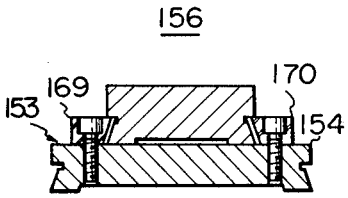
FIG. 31 is a cross-sectional view taken along substantially the line 31—31 of FIG. 30.

During the operation of the framing apparatus 50, the outside blocks 156 are set on the respective table plates 154 of the table 153 so as to be opposite to and apart at proper distances from the inside block 155. As shown in FIGS. 30 and 31, the outside blocks 156 are set on the table plates 154 by guide members 169 and 170 so as to slide in diagonal directions of the bed 151.

Each outside block 156 has a rectangular V-shaped pressing portion 171 at its front end. When the temporary inner framework 12 is set on the table 153, the outside blocks 156 can be brought into contact with the respective outer corners of the temporary inner framework 12.

Each press 158 comprises a pair of punches 173 arranged in a bore 172 in the corresponding inside block 155, a needle rod 174 arranged in the bore 172 for actuating the punches 173, and a return spring 175 for the punches 173. The hydraulic cylinder 176 are connected with the respective needle rods 174 and are driven by a pneumatic hydraulic booster 178 interposed in a hydraulic circuit 177 of the hydraulic cylinders 176. The pneumatic hydraulic booster 178 is controlled by a four way type control valve 180 interposed in a pneumatic circuit 179 of the pneumatic hydraulic booster 178.

Each punch 173 is integrally provided with a projection 182 at its front end. The rear end of the punch 173 is rotatably connected with the corresponding inside block 155 by a pin 181 in the bore 172 near the rectangular V-shaped receiving surface 168 thereof.

Each punch 173 has a pin 183 screwed in the front end thereof. Both ends of the ring-shaped return spring 175 are secured to each pin 183 of the punches 173.

Each hydraulic cylinder 176 is secured to the rear end of the corresponding inside block 155 by a pair of anchor bolts 199, lock nuts 200 and a plate 201 bridging the anchor bolts 199.

Figure 34:
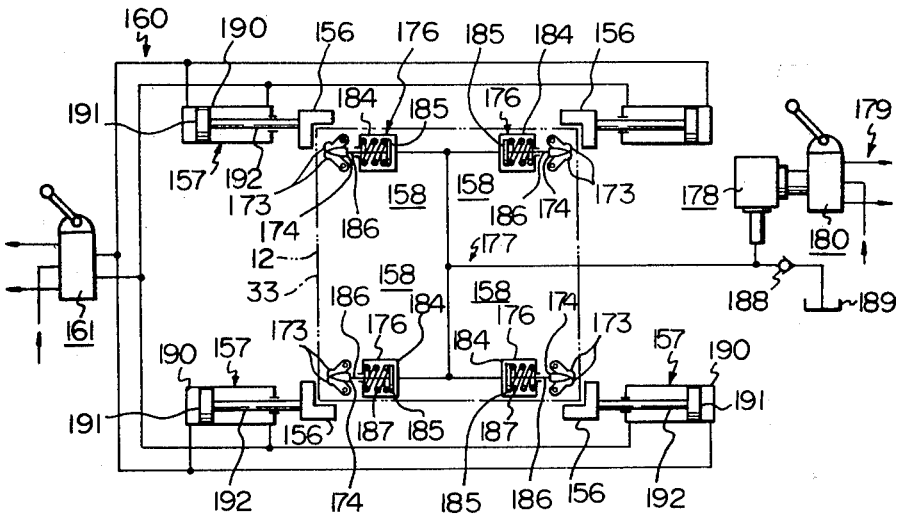
FIG. 34 is an air pressure-oil pressure circuit diagram of the framing apparatus as shown in FIG. 28.

Each hydraulic cylinder 176 is of the single action type, as shown in FIG. 34. The hydraulic cylinder 176 comprises a cylinder 184, a piston 185 slidably fitted in the cylinder 184, a rod 186 and a return spring 187. The front end of the rod 186 is connected with the needle rod 174.

Each hydraulic cylinder 176 is operated by high pressure oil supplied from the pneumatic hydraulic booster 178 which is interposed in the hydraulic circuit 177. The hydraulic circuit 177 has a check valve 188 for the pneumatic hydraulic booster 178 which is connected with an oil tank 189. The pneumatic circuit 179 for the pneumatic hydraulic booster 178 having the four way type control valve 180 is connected to an air compressor (not shown) as a pneumatic source.

Each pneumatic cylinder 157 comprises a cylinder 190, a piston 191 slidably fitted in the cylinder 190 and a rod 192 whose base end is secured to the piston 191 and whose front end is extended outwardly from the cylinder 190. The pneumatic cylinder 157 is secured to a corresponding one of the legs 152 of the bed 151 by the corresponding bracket 165. The pneumatic cylinder 157 is connected with the corresponding outside block 156 by the corresponding linkage means 159. Therefore, when the four way type control valve 161 interposed in the pneumatic circuit 160 is operated, the outside block 156 can be slid on the table plate 154 in diagonal direction of the bed 151 along the guide members 169 and 170.

The pneumatic circuit 160 for the pneumatic cylinder 157 is connected with an air compressor (not shown) as a pneumatic source.

Figure 29:
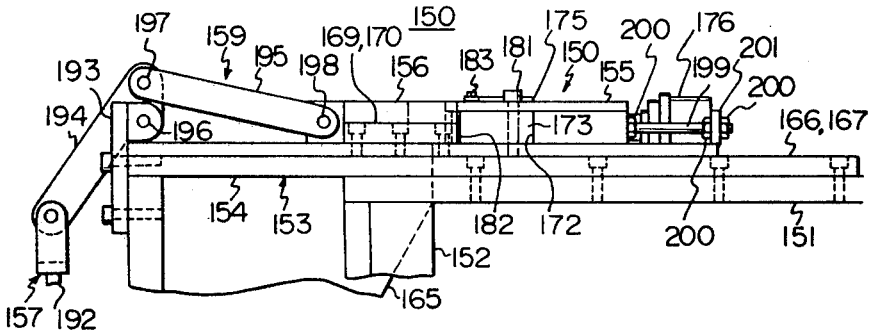
FIG. 29 is a fragmentary front view of the framing apparatus as shown in FIG. 28.

Each linkage means 159 comprises an axle support (bearing) 193 mounted to the bracket 165 by screws, a lever 194 rotatably connected with the bearing 193 by a pin 196, and a pair of links 195 connected between the upper end of the lever 194 and the rear end of the outside block 156 by pins 197 and 198, as shown in FIGS. 29 and 30. The lower end of the lever 194 is connected with the rod 192 of the pneumatic cylinder 157 by a knuckle joint.

Hereinafter, the operation of the framing apparatus 150 having the above-mentioned construction for forming the inner framework 12 is described.

Figure 28:
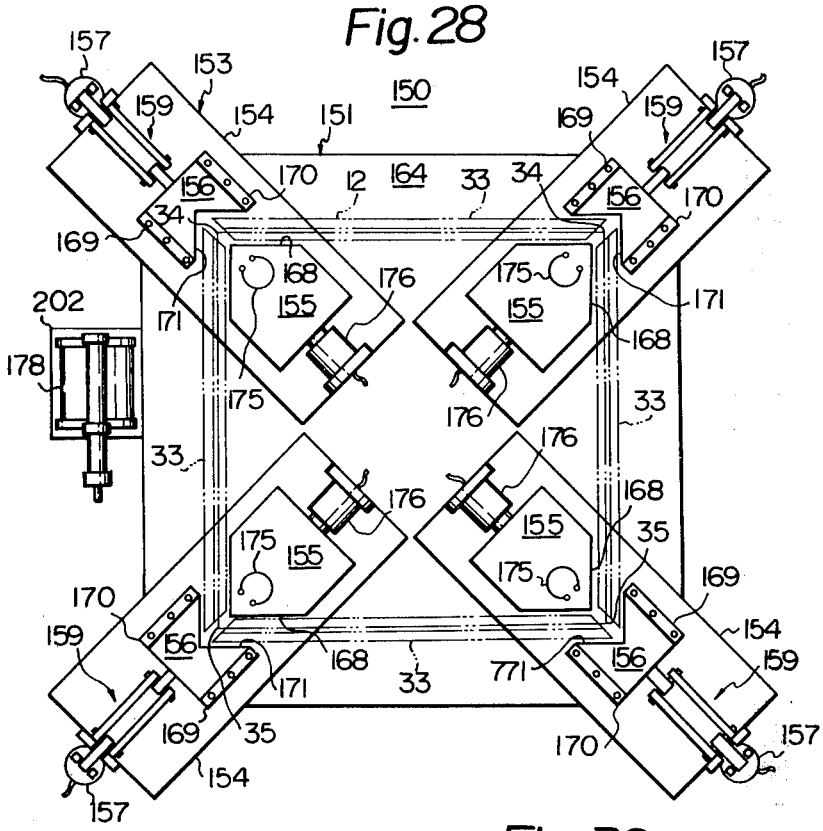
FIG. 28 is a plan view of the framing apparatus employed in framing the inner framework of the access door as shown in FIG. 1.
Figure 35:
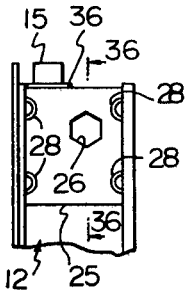
FIG. 35 is a fragmentary plan view of the corner of the inner outer framework of the access door which is assembled by the framing apparatus as shown in FIG. 28.
Figure 36:
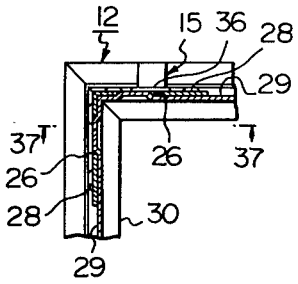
FIG. 36 is a fragmentary cross-sectional view taken along substantially the line 36—36 of FIG. 35.
Figure 37:
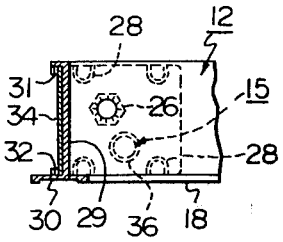
FIG. 37 is a fragmentary cross-sectional view taken along substantially the line 37—37 of FIG. 36.

As shown in FIGS. 35 through 37, four inner framework elements 33 with flanges, which have the inserting grooves 31 and 32 at the outside of their upper and lower ends, respectively, are put in square. At the four corners, the bearing side corner members 34 and the locking means side corner members 35 are temporarily fitted into the inserting grooves 31, 32 of the inner framework elements 33. Then the thus temporarily assembled square inner framework 12 is set on the table 153 of the framing apparatus 150. More particularly, since the framing apparatus 150 is in the condition as shown in FIG. 28, at first the temporary inner framework 12 is set on the table plate 154 between the inside blocks 155 and the outside blocks 156.

The four way type control valve 161 is operated so that each pneumaic cylinder 157 is brought into action so that its rod 192 is upwardly pushed out of its cylinder 190, and each outside block 156 is shifted inward to a position opposite the corresponding inside block 155 along the guide members 169 and 170 corresponding table plate 154, by the linkage means 159.

Thus, when each outside block 156 is shifted in its position toward the opposite inside block 155 by the corresponding pneumatic cylinder 157, the corresponding corner of the temporary inner framework 12 is pressed by the rectangular V-shaped pressing surface 171 of the outside block 156, and the size of the temporary inner framework 12 is contracted.

When the temporary inner framework 12 is compressed between the outside blocks 156 and the inside blocks 155, the bearing side corner members 34 and the locking means side corner members 35 are fixed into the inserting grooves 31, 32 of the inner framework elements 33 at the four corners.

Figure 33:
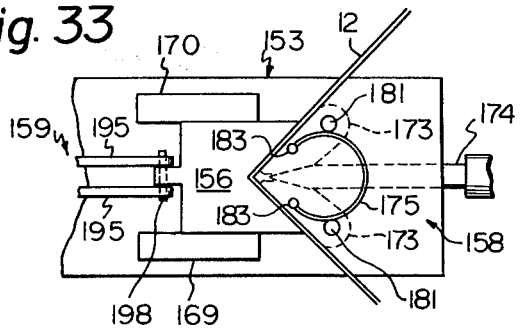
FIG. 33 is a fragmentary plan view of the framing apparatus in operating condition as shown in FIG. 30.

In this manner, each pneumatic cylinder 157 is continuously operated until each corner of the temporary inner framework 12 is pressed by the outside blocks 156, the size of the temporary inner framework 12 is contracted, and the inner and outer surfaces of the temporary inner framework 12 are held under the pressure between the rectangular V-shaped receiving surfaces 168 of the inside blocks 155 and the rectangular V-shaped pressing portions 171 of the outside blocks 156, as shown in FIG. 33.

The four way type control valve 180 then is operated, and each press 158 is actuated so that the pneumatic hydraulic booster 178 is brought into action so as to supply high pressure oil to each hydraulic cylinder 176.

Therefore, each hydraulic cylinder 176 is operated by the high pressure oil supplied from the pneumatic hydraulic booster 178 and attending with the action of each hydraulic cylinder 176, each needle rod 174 is shifted in its position to the corresponding front end of the inside block 155.

Attending the action of the needle rod 174, the punch 173 are outwardly pivoted away from each other about the pin 181 against the return spring 175. When the punches 173 are so pivoted, the projection 182 formed at the front end of each punch 173 protrudes outwardly from the rectangular V-shaped receiving surface 168. And the corner portions of the framework webs are partially pressed and deformed by each projection 182. Thus, each deformed portion of the outer surface of the framework web, which is formed by the projection 182, is pressed into the locking hole 26 of the corresponding bearing side corner member 34 and the locking means side corner member 35 so that the four inner framework elements 33 are connected to each other in square by the bearing side corner members 34 and the locking means side corner members 35, so as to form the inner framework 12, as shown in FIGS. 35 through 37.

When the four way type control valve 180 is reversely operated, the pneumatic hydraulic booster 178 reverses its action so that the piston 185 of each hydraulic cylinder 176 is returned to its initial position by the return spring 187 as shown in FIG. 34.

Attending the reverse action of each piston 185, the needle rods 174 are shifted in position to the rear end of the inside blocks 155, with the rods 186, and each punches 173 are inwardly pivoted about the pins 181 by the return springs 175. When the punches 173 are so pivoted by the return springs so as to close upon each other, the projections 182 formed at the front end of each punches 173 are retracted into the bores 172 of the inside blocks 155, behind the rectangular V-shaped receiving surfaces 168.

When the four way type control valve 161 is then reversely operated so that each pneumatic cylinder 157 is brought into reverse action so that the rods 192 are pulled downwardly into the cylinder 190, and each outside block 156 is reversely shifted in its position by the linkage means 159 so as to separate from the opposite inside block 155. Each outside block 156 is thereby returned to the former position shown in FIGS. 28 through 30.

When the distance between each inside block 155 and the opposite outside block 156 is increased as shown in FIGS. 28 through 30, the outer framework 12 can be taken out of the framing apparatus 150.

Figure 39:
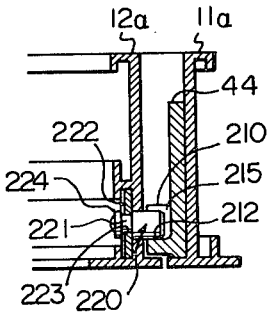
FIG. 39 is a perpendicular cross-sectional view of a modification of the shaft and the bearing employed in the access door of the present invention.
Figure 40:
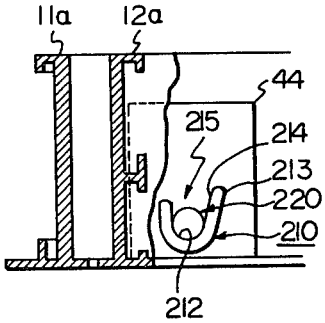
FIG. 40 is a lateral cross-sectional view of the shaft and the bearing as shown in FIG. 39.

FIGS. 39 through 42 show various modifications of the bearings 210 and 230 with the shafts 220 and 240 employed in the access door 10 of the present invention as shown in FIGS. 1 through 18. FIGS. 39 and 40 show the bearing 210, and the pin 220 as the shaft.

The bearing 210 is formed so that the pin 220 can be easily fitted in, so that the inner framework **12*a* can be easily set into the outer framework 11*a*. The bearing 210 comprises a U-shaped bearing surface 212 forming a bearing groove 211, and a stop portion 213 extending upwardly from one side portion of the bearing groove 211, having an inclined stop surface 214 continuous to the bearing surface 212, whereby the pin 220 can be smoothly moved from the stop portion 213 to the bearing groove 211**.

Thus, the pin 220 can be easily fitted into the bearing 210 by making the heights of the side portions of the bearing groove 211 different.

Furthermore, the bearing 210 is integrally formed with the bracket 44, whereby the bearing 210 can be easily secured to the outer framework **11*a*. The other end of the bearing 210 will be adjacent to the inner framework 12*a*, and the lower portion of the bearing 210 will be adjacent to the framework flange 30 of the inner framework 12*a* in order to act as the flange stop, as does the above-mentioned bearing 14**.

The bearing 210 and the bracket 44 are integrally molded of polyamide resin, fluorocarbon resin or the like by injection molding, or of zinciferous alloy, aluminous alloy or the like by die casting, so that no manual work is needed for forming the bearing surface 212.

The pin 220 is shaped so as to be durable under a heavy load, and for mounting on the inner framework **12*a*, the pin 220 is integrally provided with a sleeve 221 having a smaller diameter than that of the remainder of the pin 220. The pin 220 is put into a pin fixing hole 226 formed at the framework web of the inner framework 12*a*, and the sleeve 221 is also put into a sleeve hole 223 of a bracket 222, and a washer 224 is mounted on the sleeve 221. The head end of the sleeve 221 is fixed to the bracket 222 by calking. Thus, the pin 220 is secured to the inner framework 12*a* by the use of the bracket 222**.

Figure 41:
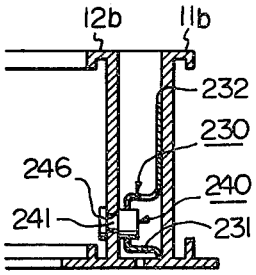
FIG. 41 is a cross-sectional view corresponding to FIG. 39, showing a further modification of the shaft and the bearing in the access door of the present invention.
Figure 42:
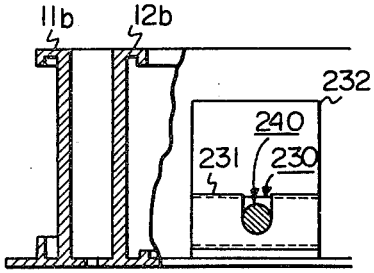
FIG. 42 is a cross-sectional view corresponding to FIG. 40, of the shaft and the bearing as shown in FIG. 41.

FIGS. 41 and 42 show a modified form of bearing 230 and pin 240. The bearing 230 is formed of a metal piece by a mechanical press. The bearing 230 has a projecting land 231 bent so as to be adjacent to the inner framework **12*b* and a U-shaped recess in the projecting land 231**.

The undersurface of the land 231 of the bearing 230 acts as the flange stop, and the securing portion 232 of the bearing 230 is fixed to the outer framework **11*b***.

The pin 240 is integrally provided with a sleeve 241 having a smaller diameter than that of the pin 240 at its end. The sleeve 241 of the pin 240 is put into a sleeve hole 246 in the inner framework **12*b*, and the head end of the sleeve 241 is fixed to the inner framework 12*b*** by calking.

Figure 43:
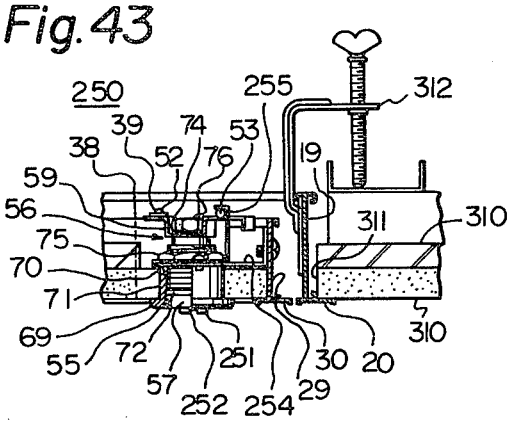
FIG. 43 is a cross-sectional view of of a modification of the locking means employed in the access door of the present invention.
Figure 44:
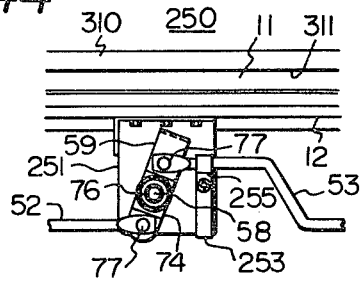
FIG. 44 is a fragmentary plan view of the locking means as shown in FIG. 43.

FIGS. 43 and 44 show a modification of the locking means 250 used in the access door 10 of the present invention as shown in FIGS. 1 through 18.

The locking means 250 has a shaft 251 in place of the plug 58 of the above-described locking means 16. The shaft 251 is provided with a groove 252 at its lower end, whereby the shaft 251 can be rotated by a screwdriver. The locking means 250 has a locking bar stop 253 in the form of a leaf spring. Further the locking means 250 has a bracket 254 for the locking bar stop 253 in place of the bracket 73 of the above-described locking means 16, and the locking bar stop 253 is secured to the bracket 254 by screws.

In the locking means 250, the pin tumblers and the springs in the plug box 57 in the above-described locking means 16 are omitted.

The locking bar stop 253 is formed by bending a leaf spring in an L-shaped and bending its end so as to form a hook 255, as shown in FIG. 43. One locking bar 53 is hitched on the hook 255, and the locking bars 52 and 53 are held in the locked position and the unlocked position, whereby the locking bars 52 and 53 will not come off the locking bar receiver 54 if an earthquake occurs.

FIGS. 45 through 50 show modifications 260, 270, 280, 290 and 300 of the locking bar receiver for the locking means 16 of the access door 10 of the present invention as shown in FIGS. 1 through 18. The locking bar receiver 260 shown in FIGS. 45 and 46 has a locking bar receiving hole 261 formed in the framework web 19 of the outer framework 11, and a pocket 262 formed by pressing a portion of the framework web out of the locking bar receiving hole 261.

Figure 45:
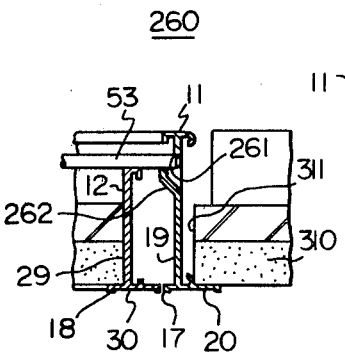
FIG. 45 is a cross-sectional view of a modification of the locking bar support used in the locking means of the access door of the present invention.
Figure 46:
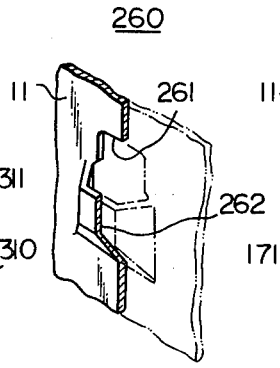
FIG. 46 is a perspective view of the locking bar of the locking means as shown in FIG. 45, partially in cross-section.
Figure 47:
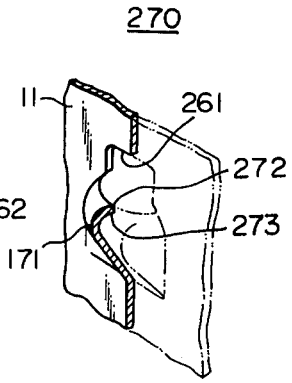
FIGS. 47 through 50 are perspective views of the further modifications of the locking bar supports used in the locking means of the access door of the present invention, partially in cross-section.
Figure 48:
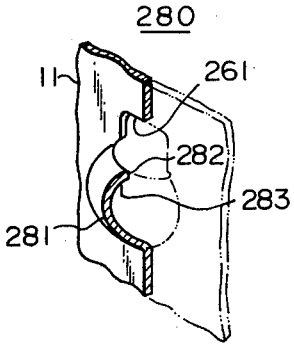

The locking bar receiver 270 shown in FIG. 47 has a warped spherical pocket 271 corresponding to the pocket 262 of the locking bar receiver 260 as shown in FIGS. 45 and 46, and a socket-forming portion 272 of the warped spherical pocket 271 has a curled lip 273. The locking bar receiver 280 shown in FIG. 48 has a spherical pocket 281 corresponding to the pocket 262 of the locking bar receiver 260 as shown in FIGS. 45 and 46, and a pocket-forming portion 282 of the spherical pocket 281 has a curled lip 283.

Figure 49:
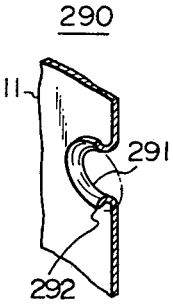

The locking bar receiver 290 shown in FIG. 49 has a locking bar receiving hole 291 formed in the framework web 19 of the outer framework 11, and the edge around the locking bar receiving hole 291 is inwardly bent so as to form a curled lip 292.

Figure 50:
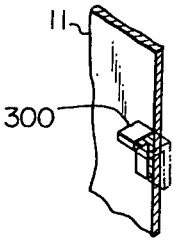

The locking bar receiver 300 shown in FIG. 50 is formed of angle iron.

With the locking bar receivers 260, 270, 280, 290 and 300 having the above-described construction, the locking bars 52 and 53 will not come off these locking bar receivers if an earthquake occurs, since the locking bars 52 and 53 are received in the locking bar receivers, being contacted in a proper distance.

The tapping washer 56 of the locking means 16 employed in the access door 10 of the present invention may be provided with modified sawteeth in place of the sawteeth 70 in accordance with the material of the cover plate 13.

While several preferred embodiments of the invention have been shown and described in detail, it will be understood that the same are for illustration purpose only and not to be taken as a definition of the invention, reference being had for this purpose to the appended claims.

What is claimed is:

1. An access door comprising:

an outer framework adapted to be fitted in a rough opening formed in a building ceiling, wall, or the like, said outer framework including four outer framework elements positioned in square so as to define four first corners, said four outer framework elements having first upper and lower inserting grooves at opposite ends thereof at the outer sides of each of said four first corners, and four outer framework corner members respectively disposed in said first upper and lower inserting grooves at said four first corners so as to hold said four outer framework elements in abutting relation at said four first corners;

an inner framework set in an opening in the outer framework, said inner framework including four inner framework elements positioned in square so as to define four second corners, said four inner framework elements having second upper and lower inserting grooves at opposite ends thereof at the outer sides of each of said four second corners, and four inner framework corner members respectively disposed in said second upper and lower inserting grooves at said four second corners so as to hold said four inner framework elements in abutting relation at said four second corners;

a cover plate secured to the inner framework so as to close the opening in the inner framework;

a pair of bearings on one of the opposed inner surfaces of the outer framework and outer surfaces of the inner framework, said bearings having U-shaped grooves, respectively;

a pair of bearing pins projecting from the other of the opposed inner surfaces of the outer framework and the outer surfaces of the inner framework, and pivotally supported in the bearings, respectively; and a locking means including a box extending through and secured to the cover plate, a shaft supporting bracket, a shaft fitted in the box and rotatably supported on the inner framework by the shaft supporting bracket, said shaft being operable from the outside of the cover plate, and locking bars pivotally connected to the shaft so as to be movable into and out of the outer framework upon the rotation of the shaft.

2. An access door as claimed in claim 1 in which said other of the opposed outer framework corner members and inner framework corner members have fixing holes therein fixingly holding said pair of bearing pins.

3. An access door as claimed in claim 1, in which each of said pair of bearings has projecting portions narrowing the upper portion of the opening into the U-shaped grooves so as to snap fit said bearing pins in said U-shaped grooves.

4. An access door as claimed in claim 1, in which each of said pair of bearings is a pressed metal piece having a projecting land with a U-shaped recess therein for fitting said bearing pins therein.

5. An access door as claimed in claim 1, further comprising bearing brackets fixed to the one of the opposed outer framework and inner framework surfaces at the positions of the bearings, and each bearing is integral with a corresponding one of the bearing brackets.

6. An access door as claimed in claim 5, in which each of the bearing brackets has a grooved sleeve extending through the corresponding outer or inner framework and a knock pin force fitted into the grooved sleeve for securing the bearing bracket to the corresponding outer or inner framework.

7. An access door as claimed in claim 1, in which the locking means comprises a pair of locking bars on the inner framework, guide members on said inner framework slidably supporting the forward ends of each of said pair of locking bars, a pair of locking bar receivers on the outer framework for receiving the forward end of the corresponding locking bars, a tapping washer having sawteeth therein extending through the cover plate, a cylinder lock mounted in said tapping washer and secured to the inner framework by the shaft supporting bracket, a control plate fixed to the shaft from the cylinder lock and connected to the base end of each of the locking bars, respectively, and a key for the cylinder lock.

8. An access door as claimed in claim 7, in which said shaft has a groove at its end, and said locking means has a locking bar stop constituted by a leaf spring.

9. An access door as claimed in claim 1, in which the outer framework has a framework web with flanges on the top and bottom thereof, and said web has locking bar receivers for receiving the forward end of each of the locking bars of the locking means.

10. An access door as claimed in claim 9, in which each locking bar receiver has a locking bar receiving hole and a pocket extending outwardly from the web beneath the locking bar receiving hole.

11. An access door as claimed in claim 10, in which the pocket is warped spherical, and the warped spherical pocket has a curled lip.

12. An access door as claimed in claim 9, in which the locking bar receivers each have a locking bar receiving hole, and said locking bar receiving hole has a curled lip.

13. An access door as in claim 1, wherein each of said four outer framework corner members are right-angled and have first locking holes therein, each of said four outer framework elements having first deformed portions at opposite ends thereof projecting into said first locking holes for locking said four outer framework corner members to said four outer framework elements; and each of said four inner framework corner members is right-angled and has second locking holes therein, each of said four inner framework elements having second deformed portions at opposite ends thereof projecting into said second locking holes for locking said four inner framework corner members to said four inner framework elements.

14. An access door as claimed in claim 13, in which at least one inner framework corner member has a guide for at least one of the locking bars of the locking means.

15. An access door comprising:

an outer framework adapted to be fitted in a rough opening formed in a building ceiling, wall, or the like, said outer framework comprising four outer framework elements and four outer framework corner members holding said four outer framework elements together;

an inner framework set in an opening in the outer framework, said inner framework comprising four inner framework elements and four inner framework corner members holding said four inner framework elements together;

a cover plate secured to the inner framework so as to close the opening in the inner framework;

a pair of bearings on one of the opposed inner surfaces of the outer framework and outer surfaces of the inner framework, said bearings having U-shaped grooves, respectively;

a pair of bearing pins projecting from the other of the opposed inner surfaces of the outer framework and the outer surfaces of the inner framework, and pivotally supported in the bearings, respectively; and a locking means including a box extending through and secured to the cover plate, a shaft supporting bracket, a shaft fitted in the box and rotatably supported on the inner framework by the shaft supporting bracket, said shaft being operable from the outside of the cover plate, and locking bars pivotally connected to the shaft so as to be movable into and out of the outer framework upon the rotation of the shaft;

each of the four outer framework corner members and each of the four inner framework corner members being right-angled and having a pair of locking holes;

at least one inner framework corner member having a guide for at least one of the locking bars of the locking means.

16. An access door as claimed in claim 15 in which said outer framework is comprised of four outer framework elements and four outer framework corner members holding said four outer framework elements together; and said inner framework comprising four inner framework elements and four inner framework corner members holding said four inner framework elements together.

17. An access door comprising:

an outer framework adapted to be fitted in a rough opening formed in a building ceiling, wall, or the like;

an inner framework set in an opening in the outer framework;

a cover plate secured to the inner framework so as to close the opening in the inner framework;

a pair of bearings on one of the opposed inner surfaces of the outer framework and outer surfaces of the inner framework, said bearings having U-shaped grooves, respectively;

a pair of bearing pins projecting from the other of the opposed inner surfaces of the outer framework and the outer surfaces of the inner framework, and pivotally supported in the bearings, respectively;

bearing brackets fixed to the one of the opposed outer framework and inner framework surfaces at the positions of the bearings, each bearing being integral with a corresponding one of the bearing brackets, each of the bearing brackets having a grooved sleeve extending through the corresponding outer or inner framework and a knock pin force fitted into the grooved sleeve for securing the bearing bracket to the corresponding outer or inner framework; and a locking means including a box extending through and secured to the cover plate, a shaft supporting bracket, a shaft fitted in the box and rotatably supported on the inner framework by the shaft supporting bracket, said shaft being operable from the outside of the cover plate, a pair of locking bars pivotally connected to the shaft so as to be movable into and out of the outer framework upon the rotation of the shaft.

18. An access door comprising:

an outer framework adapted to be fitted in a rough opening formed in a building ceiling, wall, or the like;

an inner framework set in an opening in the outer framework;

a cover plate secured to the inner framework so as to close the opening in the inner framework;

a pair of bearings on one of the opposed inner surfaces of the outer framework and outer surfaces of the inner framework, said bearings having U-shaped grooves, respectively;

a pair of bearing pins projecting from the other of the opposed inner surfaces of the outer framework and the outer surfaces of the inner framework, and pivotally supported in the bearings, respectively; and a locking means including a box extending through and secured to the cover plate, a shaft supporting bracket, a shaft fitted in the box and rotatably supported on the inner framework by the shaft supporting bracket, said shaft being operable from the outside of the cover plate, a pair of locking bars pivotally connected to the shaft so as to be movable into and out of the outer framework upon the rotation of the shaft, guide members on said inner framework slidably supporting the forward end of each of said pair of locking bars, a pair of locking bar receivers on the outer framework for receiving the forward ends of the corresponding locking bars, a tapping washer having sawteeth therein extending through the cover plate, a cylinder lock mounted in said tapping washer and secured to the inner framework by the shaft supporting bracket, a control plate fixed to the shaft from the cylinder lock and connected to the base end of each of the locking bars, respectively, and a key for the cylinder lock.

19. An access door as claimed in claim 18, in which said shaft has a groove at its end, and said locking means has a locking bar stop constituted by a leaf spring.

20. An access door comprising:

an outer framework adapted to be fitted in a rough opening formed in a building ceiling, wall, or the like;

an inner framework set in an opening in the outer framework;

a cover plate secured to the inner framework so as to close the opening in the inner framework;

a pair of bearings in one of the opposed inner surfaces of the outer framework and outer surfaces of the inner framework, said bearings having U-shaped grooves, respectively;

a pair of bearing pins projecting from the other of the opposed inner surfaces of the outer framework and the outer surfaces of the inner framework, and pivotally supported in the bearings, respectively; and a locking means including a box extending through and secured to the cover plate, a shaft supporting bracket, a shaft fitted in the box and rotatably supported on the inner framework by said shaft supporting bracket, said shaft being operable from the outside of the cover plate, and locking bars pivotally connected to the shaft so as to be movable into and out of the outer framework upon the rotation of the shaft, the outer framework having a framework web with flanges on the top and bottom thereof, said web having locking bar receivers for receiving the forward end of each of the locking bars of the locking means, each locking bar receiver having a locking bar receiving hole and a pocket extending outwardly from the web beneath the locking bar receiving hole.

21. An access door as claimed in claim 20, in which the pocket is warped spherical, and the warped spherical pocket has a curled lip.

22. An access door comprising:

an outer framework adapted to be fitted in a rough opening formed in a building ceiling, wall, or the like;

an inner framework set in an opening in the outer framework;

a cover plate secured to the inner framework so as to close the opening in the inner framework;

a pair of bearings on one of the opposed inner surfaces of the outer framework and outer surfaces of the inner framework, said bearings having U-shaped grooves, respectively;

a pair of bearing pins projecting from the other of the opposed inner surfaces of the outer framework and the outer surfaces of the inner framework, and pivotally supported in the bearings, respectively; and a locking means including a box extending through and secured to the cover plate, a shaft supporting bracket, a shaft fitted in the box and rotatably supported on the inner framework by said shaft supporting bracket, said shaft being operable from the outside of the cover plate, and locking bars pivotally connected to the shaft so as to be movable into and out of the outer framework upon the rotation of the shaft, the outer framework having a framework web with flanges on the top and bottom thereof, and said web having locking bar receivers for receiving the forward end of each of the locking bars of the locking means, the locking bar receivers each having a locking bar receiving hole, and said locking bar receiving hole having a curled lip.

* * * * *